United States Patent [19]

Fortunato

[11] 4,166,537

[45] Sep. 4, 1979

[54] WATERPROOF PILL CONTAINER

[76] Inventor: Samuel F. Fortunato, 115 Bow St., East Greenwich, R.I. 02818

[21] Appl. No.: 849,522

[22] Filed: Nov. 7, 1977

[51] Int. Cl.[2] ..... B65D 39/18; B65D 45/14

[52] U.S. Cl. ..... 206/535; 220/251

[58] Field of Search ..... 206/535, 811; 220/243, 220/250, 251; 215/294, 355, 356

[56] References Cited

U.S. PATENT DOCUMENTS

| | | | |
|---|---|---|---|
| 1,023,560 | 4/1912 | Glaser | 215/356 |
| 1,060,693 | 5/1913 | Mueller | 220/251 |
| 1,174,278 | 3/1916 | Prier | 220/251 |
| 1,797,766 | 3/1931 | Frye | 220/243 |
| 2,706,464 | 4/1955 | North | 206/535 |
| 2,853,203 | 9/1958 | Evans | 220/251 |
| 3,768,636 | 10/1973 | O'Connell | 206/535 |

*Primary Examiner*—Herbert F. Ross

*Attorney, Agent, or Firm*—Salter & Michaelson

[57] ABSTRACT

A waterproof pill container especially adapted to hold pills and the like is disclosed. In addition to a container base having an open top adapted to be closed by a cover, closure means are provided for continually urging the cover into watertight sealing engagement with the peripheral edge that forms the open top of the container base. Such closure means includes a post attached to and downwardly dependent from the inner portions of the cover and to which a laterally extending crossbar is rotatably engaged. Also the container base is provided with a pair of inwardly extending flanges under which the ends of the crossbar are adapted to engage, thereby establishing anchor points against which the cover may be tightly drawn into sealing engagement with the container base to assure a watertight fit between the two members.

4 Claims, 4 Drawing Figures

WATERPROOF PILL CONTAINER

BACKGROUND OF THE INVENTION

This invention relates to a container, and one particularly adapted for containment of medicinal materials, such as pills and the like in an absolutely watertight condition. Pill containers of the conventional type that include a plastic frictionally snap-locking cover serve to adequately contain pills and the like under normal situations. However, many people have a need to have medications on their person even when engaging in recreational or sporting activities such as swimming. Under such circumstances, it is necessary that the container holding such pills be watertight so that the pills are available in a desired condition when needed to be administered by the user or someone in the vicinity if the wearer should be incapacitated.

Several patents, including U.S. Pat. No. 2,006,773 to Moore et al and U.S. Pat. No. 1,789,088 to Sopronyi, show containers especially adapted for use in a water environment such as when bathing. Other patents of interest are U.S. Pat. No. 1,258,682 to Hood and No. 372,680 to Ketcham, both of which pertain to locking cover constructions. The citation and discussion of the above indicated U.S. patents constitutes applicant's Prior Art Disclosure.

SUMMARY OF THE INVENTION

Form the foregoing, it is believed that the need exists for a waterproof container which is especially adapted for the containment of pills and the like, and which may further be easily tethered or otherwise carried on the user's person regardless of the activity in which he or she is engaged.

It is accordingly a primary object of the present invention to provide a waterproof pill container which may be easily transported by the wearer so as to be available at all times regardless of the activity in which the user is engaged.

It is a further object of the present invention for a provision of a waterproof pill container in which the cover portion thereof is continually urged into a watertight sealing engagement with a container base portion thereof, and wherein the watertight engagement between said members is not adversely affected by repeated use or minor wear in such members.

A still further object of the present invention is the provision of a waterproof pill container of the above-indicated type which is relatively easy to open and close and from which pills and the like may be easily dispensed, if needed.

Still another object of the present invention is the provision of a waterproof pill container of the above indicated type which can be readily adapted for tethered attachment to the user's body as by wearing as a necklace or the like.

These and other objects of the present invention are accomplished by the provision of a waterproof container comprising an open top container base having sidewalls which terminate in an upper peripheral edge defining the open top. A cover is adapted to engage the peripheral edge in sealing contact, and closure means are further provided for continually urging and maintaining such sealing relationship between the aforementioned members. Such closure means includes a threaded post integrally secured to the underside of the cover and to which a crossbar is rotatably engaged. The container base sidewalls are further provided with a pair of flanges inwardly extending towards each other, and under which the ends of the crossbar are engageable. After such engagement, the cover may be rotated so as to vary the longitudinal distance between the crossbar and the cover so as to draw the cover tightly against the peripheral edge to seal the container.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

in FIG. 2; and

DESCRIPTION OF THE INVENTION

Figure 1:
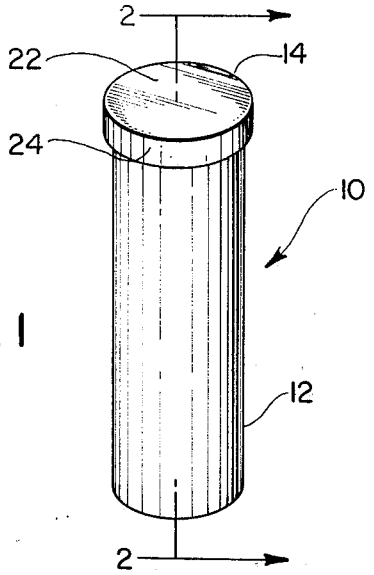
FIG. 1 is a perspective view showing the container of the present invention.

Referring now to the drawing and particularly to FIG. 1 thereof, the container as embodied in the present invention is illustrated and is generally indicated at 10. The container 10 includes a generally cylindrical, longitudinally orientated container base 12 and a cover 14. The container base 12, in turn, includes a bottom wall 16 from which sidewalls 18 extend upwardly and terminate in an upper peripheral edge 20. The container base 12 can thus be defined as an open top member. The cover, on the other hand, includes a top wall 22 of generally flat circular construction and from which a peripheral lip 24 downwardly extends, the lip 24 being adapted to engage outer upper portions of the base member sidewalls 18. The inner or lower surface of the top wall 22 is provided with a seal 26 either in the form of a separate insert attached thereto or by a coating applied to such surface. The seal 26 is preferably of any known flexible plastic material such as polyurethene foam, while the remaining portions of the cover 14 may be formed from a relatively stiff material which may include plastic materials as well as metal.

In order to insure the existence of a watertight seal between the peripheral edge 20 and the cover 14 at all times, closure means generally indicated at 28 is provided that continually urges the cover 14 and base 12 into mutual contact with each other. The closure means 28 includes a post 30 connected at one end to the under side of the cover top wall 22 as by an adhesive connection, welding,soldering, brazing or the like. The post 30 extends downwardly into the container base 12, and the lower end of the post 30 has screw threads 32 formed thereon in such a manner as to threadably and rotatably receive a laterally extending crossbar 34. The crossbar 34 is formed with a threaded opening 36 centrally thereof and also has knurled upper portions 38 formed on each lateral edge thereof. The terminal portion of the outer edge post 30 is provided with an enlargement 40 which may more simply be a peened over edge portion, so as to prevent the crossbar 34 from being inadvertently removed from the post 30.

Figure 2:
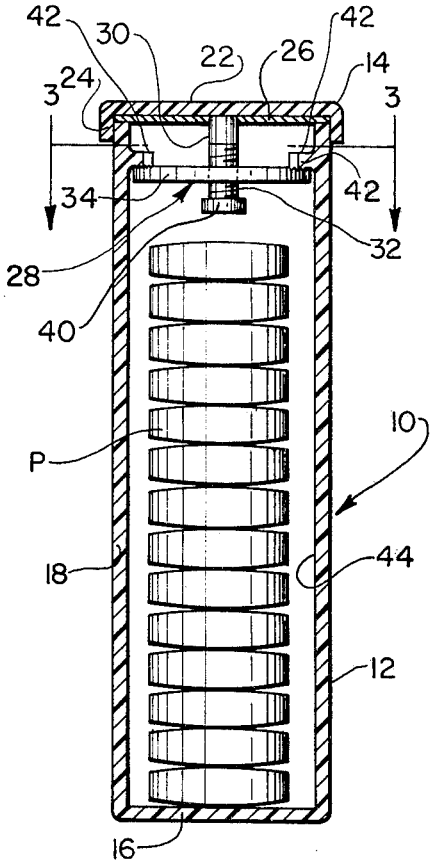
FIG. 2 is a sectional view taken along line 2—2 in FIG. 1.
Figure 4:
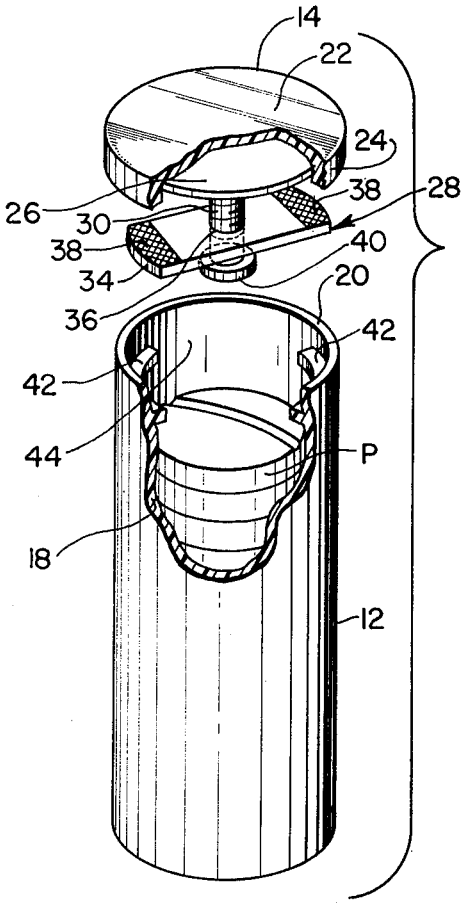
FIG. 4 is an exploded perspective view of the container with parts broken away for clarity.
Figure 3:
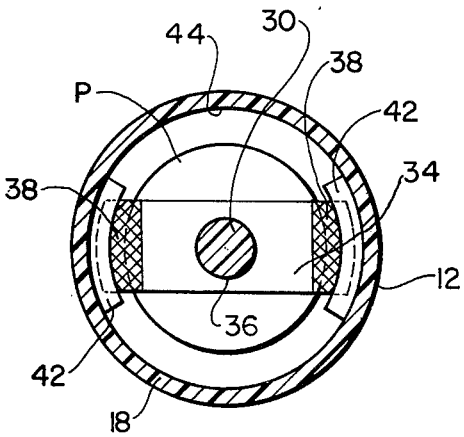
FIG. 3 is a sectional view taken along line 3—3.

Inner portions of the container sidewalls 18 are formed with a pair of spaced flanges 42 at the upper end thereof, the flanges 42 being located in such a manner that each flange is disposed in opposed and spaced relationship to each other and define spaces 44 therebetween. The flanges 42 furthermore arcuately extend about the inner periphery of the container base 12 in approximately a 45° segment. Also the radial inward extent of the flanges 42 is such that the outermost ends of the crossbar 34 may be positioned therebeneath. In such position, the knurled surfaces 38 of the crossbar 34 engage the lower surface of the flanges 42 so as to position the cover 14 relative to the container base 12. Thereafter simultaneous engagement between the crossbar 34 and the flanges 44 and rotation of the cover 14 will move the cover 14 relative to both the crossbar 34 and the container base 12 inasmuch as the mutual contact between the crossbar and flanges serves to anchor the closure means 28 into position relative to the container base 12. When the cover rotation is in a clockwise direction, assuming right-handed post threads, the cover will be drawn towards the container base 12 to seal such in water tight engagement against the peripheral edge 20 as shown in FIG. 2 of the drawing. Similarly, rotation of the cover in a counterclockwise direction increases the longitudinal spacing between the cover and the container base. The extent to which the cover is forced against the peripheral edge 20 depends, of course, on the degree of rotation imparted to the cover. Thus, should the resiliency of the seal 26 become impaired through age or use or should the inner surface of the cover or the peripheral edge 20 exhibit slight irregularities, such imperfections can be overcome by increasing the rotational tightening force of the cover so that medicines such as the pills indicated at P located within the container 10 will be maintained in a watertight state therein under all conditions of container use.

To facilitate closure of the container, the crossbar 34 is rotationally orientated so as to fit into the spaces 44 disposed between the flanges 42 and in this manner, enable it to longitudinally slide past the flanges. Thereafter the cover, and accordingly the crossbar 34, may be rotated so as to dispose the ends of the crossbar beneath the flanges 42 such that the knurled portion 38 thereof engage under surface portions of the flanges 42. A slight upward force on the cover 14 will then act to anchor the crossbar, against the flanges 42, and a simultaneous rotation of the cover 14 will force the underside of the cover into a close watertight position upon the container base 12. The reverse of the above indicated operational sequence serves to loosen and subsequently remove the cover 14 from the container base 12.

The container 10 is generally wide enough to accept the pills P with adequate room on either side thereof such that the pills P may be easily dispensed between the narrow throat formed by the spaced flanges 40 at the upper edge thereof, and is also long enough so that an adequate supply of such pills may be stored therein. The overall dimensions of the container is such that it may be easily carried on the user's person, and may also include an integral eyelet or the like provided on some part thereof, such that the container may be tethered to the user while he is engaged in an activity that does not readily permit carrying the container in clothing, such as swimming.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A waterproof pill container, comprising an open top container base having a bottom wall and sidewalls upstanding therefrom, said base of longitudinally orientated cylindrical configuration such that relatively disc-like configured pills may be vertically stacked therein one upon the other with the lateral side edges of said pills spaced from said sidewalls, said sidewalls terminating in an upper peripheral edge, a circular cover having a top wall and adapted to close said open top by sealing contact of said top wall with said peripheral edge, and closure means for continually urging and maintaining said top wall in sealing contact with said edge, said closure means including a post integrally secured to the underside of said cover top wall at one end thereof and having its other lower end adapted to longitudinally downwardly extend into said container base, said other lower end of said post being threaded, a crossbar threadably secured to said lower post end, said crossbar laterally extending across said container base and terminating proximate to but spaced from opposed upper sidewall portions thereof, said upper sidewall portions each having inwardly laterally extending flanges adapted to overlie the end portions of said crossbar wherein simultaneous engagement of said crossbar with said flanges and rotation of said top causes said top to move longitudinally with respect to said container base, the upper surface of said crossbar ends being knurled, said knurled end portions being adapter to contact the lower surface of said flanges, the lateral distance between said flanges being slightly greater than that of said pills such that they may move therepast for one at a time dispensing through said open top of said container base when the cover is removed from said base.

2. The container of claim 1, there being a pair of said flanges radially inwardly extending from opposite sides of said sidewalls, each said flange extending in an arc about the inner periphery of said container base and being arcuately spaced from each other, said bar being adapted to longitudinally move past said flanges in said arcuate spaces.

3. The container of claim 2, the arcuate extent of each such flange being about 45°.

4. The container of claim 1, said crossbar being longitudinally movable with respect to said cover top wall so as to adjust the spacing therebetween.

* * * * *